United States Patent [19]

Abdelgawad

[11] Patent Number: 4,727,892

[45] Date of Patent: Mar. 1, 1988

[54] VENTILATED CIGARETTE

[75] Inventor: Ahmed Abdelgawad, Colombier, Switzerland

[73] Assignee: Fabriques de Tabac Reunies, S.A., Neuchatel, Switzerland

[21] Appl. No.: 829,154

[22] Filed: Feb. 14, 1986

[30] Foreign Application Priority Data

Mar. 7, 1985 [EP] European Pat. Off. ..... 85301586.5

[51] Int. Cl.[4] ..... A24D 3/04

[52] U.S. Cl. ..... 131/336; 131/198.2

[58] Field of Search ..... 131/336, 198.1, 198.2

[56] References Cited

U.S. PATENT DOCUMENTS 2,804,078 8/1957 Saffir .
2,841,153 7/1958 Pelletier .
2,923,647 2/1960 Aghnides .
2,936,763 5/1960 Saffir .
3,759,268 9/1973 Plourde .
4,256,122 3/1981 Johnson ..... 131/336

FOREIGN PATENT DOCUMENTS 706624 3/1954 United Kingdom .

*Primary Examiner*—V. Millin
*Attorney, Agent, or Firm*—Jeffrey H. Ingerman

[57] ABSTRACT

A filter cigarette has a wrapper surrounding the filter and retaining it on the end of the tobacco rod. At least one portion of the wrapper overlying the filter and extending circumferentially at least partly around the cigarette at a distance from the mouth end is delimited by a line or lines of weakness in the wrapper and is at least partly removable to expose a portion of the surface of the filter, whereby ventilating air can pass beneath the wrapper to reach the mouth end of the cigarette.

10 Claims, 8 Drawing Figures

VENTILATED CIGARETTE

BACKGROUND OF THE INVENTION

The present invention relates to filter cigarettes having a controllable degree of ventilation.

In the provision of cigarettes having reduced deliveries of tar or total particulate matter (TPM), two measures are commonly adopted, namely the provision of a smoke filter at the mouth end of the cigarette, and means for admitting air into the cigarette whereby the smoke stream is diluted, either within the cigarette itself or in the mouth of the smoker.

U.S. Pat. No. 2,936,763 (Saffir) describes a filter cigarette in which the wrapper is formed with a longitudinally extending region perforated or otherwise weakened along its edge so that sections of the wrapper can be easily torn off to admit air into the cigarette. In all the embodiments the region at least partly overlies the tobacco filler, although in one embodiment one small section may overlap the filter.

SUMMARY OF THE INVENTION

It is an object of the present invention to provide improved means whereby a controlled proportion of ventilating air can be admitted to a filter cigarette in accordance with the wish of the smoker.

According to the present invention, a filter cigarette is characterized in that at least one portion of the wrapper overlying the filter and extending circumferentially at least partly around the cigarette at a distance from the mouth end thereof is delimited by a line or lines of weakness in the wrapper and is at least partly removable to expose a portion of the surface of the filter, whereby ventilating air can pass beneath the wrapper to reach the mouth end of the cigarette.

The filter may consist of a simple rod of fibrous or other filter material, or of two or more aligned or abutting filter elements. The wrapper may be constituted by a single sheet, normally of paper, enveloping both the filter and the tobacco rod, but may equally conveniently be in the form of a tipping sheet surrounding the filter and overlapping the wrapped tobacco rod.

The removable strip is conveniently defined by a line or lines of perforations, which can easily be formed at high speed, either during the course of cigarette manufacture or as a preliminary operation. The removable portion may be in one or more parts and may be provided with one or more tab regions which may, for example, be partially surrounded by a line of severance to form a region easily lifted by a finger of the smoker.

A particularly preferred arrangement is one in which the removable portion is constituted by an annular strip or annular series of strips extending completely around the cigarette at a distance from the mouth end. If such a strip or series of strips is to be completely removed, then it is preferable that the integrity of the cigarette and the remaining portions of the wrapper be maintained by ensuring that the main body of the wrapper and the separated mouth end region are both adherent to the filter. Two or more such annular strips may be spaced along the wrapper, the wrapper being adherent to the filter on either side of the strips and optionally between each strip.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 4:
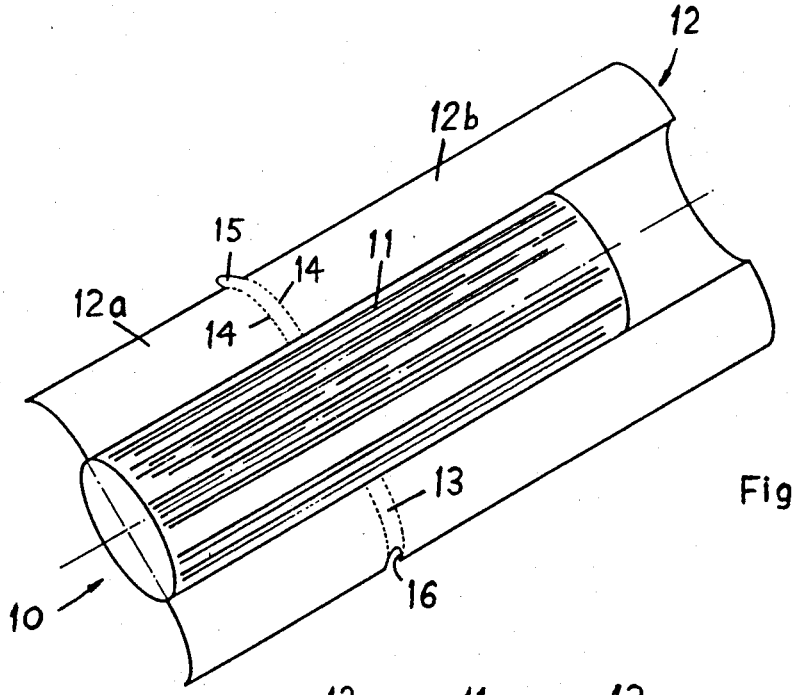
FIG. 4 is an isometric view of the mouth end of the cigarette of FIG. 1 with the wrapper peeled back.

In the cigarettes shown in FIGS. 1 to 4, the mouthward end portion 10 is occupied by a filter rod 11, for example, of fibrous material having an air-permeable peripheral surface. The filter rod is secured to the rod of tobacco filler or other smokable material (not shown) by means of a wrapper 12 of paper or other suitable sheet material, extending around the filter rod 11 and along at least part of the rod of smokable material. Where the wrapper 12 is a tipping sheet and merely overlaps the end of the filler rod, the latter may be provided with its own separate wrapper to which the tipping 12 may be secured, for example by adhesive.

In accordance with this invention, the wrapper 12 is formed with a removable annular strip or series of strips 13 which extends around the cigarette in the region of the filter rod 11 and divides the wrapper into a mount end portion **12*a* and a remainder 12*b*. The portions 12*a* and 12*b* are each separately retained on the filter rod 11**, preferably by means of adhesive.

The strip or strips 13 are delimited by lines of weakness 14 in the wrapper material, which are most conveniently constituted by lines of perforations. In addition, at least one portion 15 of the strip is partly defined by a line of severance of the wrapper, whereby each portion 15 constitutes a tab which can be readily lifted by a finger of the smoker.

The lines of perforations defining the removable strip or strips 13 can be easily formed in the wrapper material, either as a preliminary treatment or during the course of manufacture of the cigarettes. A tab 15 at the edge of the portion of the wrapper corresponding to a single cigarette may be formed at the same time as the wrapper material is divided into individual lengths. In such a case, the projection from one severed edge forming the tab 15 will correspond to a recess 16 at the opposite edge, as shown in FIG. 4.

Figure 1:
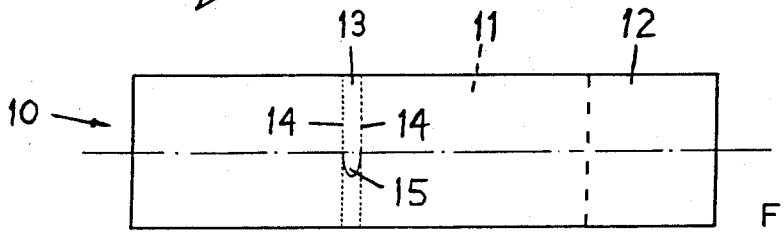
FIG. 1 is a side view of the mouth end of a filter cigarette incorporating the invention.

In the case of FIGS. 1 and 4, the mouth end of the cigarette is surrounded by a unitary annular strip 13, which can be partly or wholly removed by pulling the tab 15. This admits air to the filter body when the smoker draws on the cigarette, the quantity of air being determined by the extent to which the strip 13 is removed.

Figure 2:
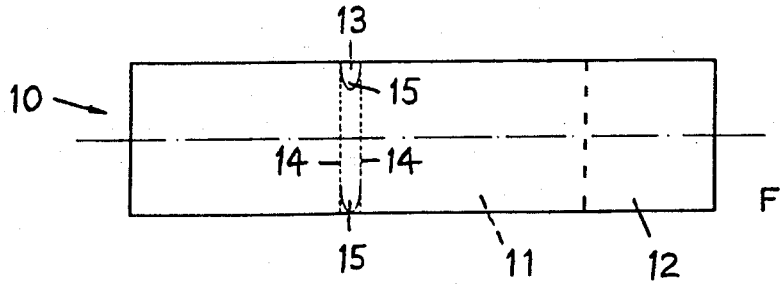
FIG. 2 is a similar view of a second form of cigarette embodying the invention.
Figure 3:
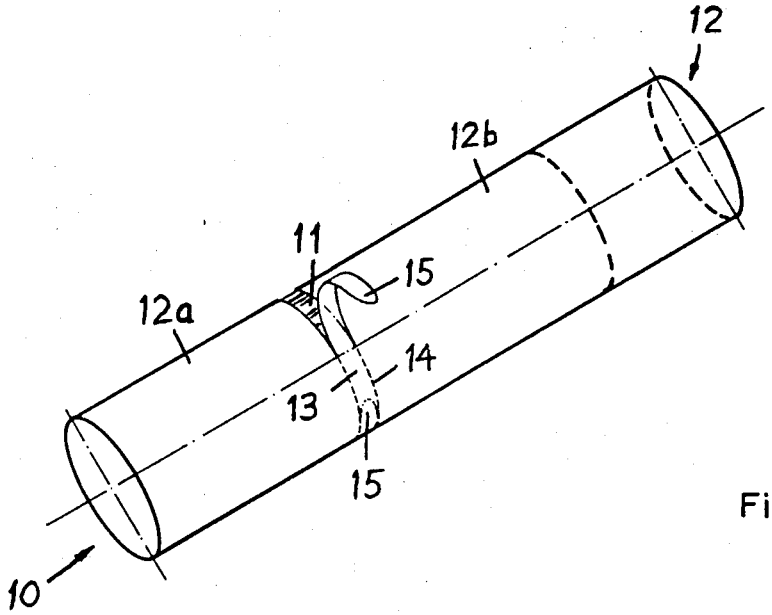
FIG. 3 is an isometric view of the mouth end of a cigarette similar to that of FIG. 2.

In the cigarettes shown in FIGS. 2 and 3, more than one severed tab region 15 is provided in the circuit of the annular strip 13. With such an arrangement, a smoker desiring a degree of the ventilation corresponding to only partial removal of the strip 13 can achieve this result by totally removing only that part of the strip extending between one tab and another. This avoids the inconvenience of having the detached part of a partially removed strip projecting from the cigarette, or of having to tear away such projecting part without detaching the remainder of the strip.

Figure 5:
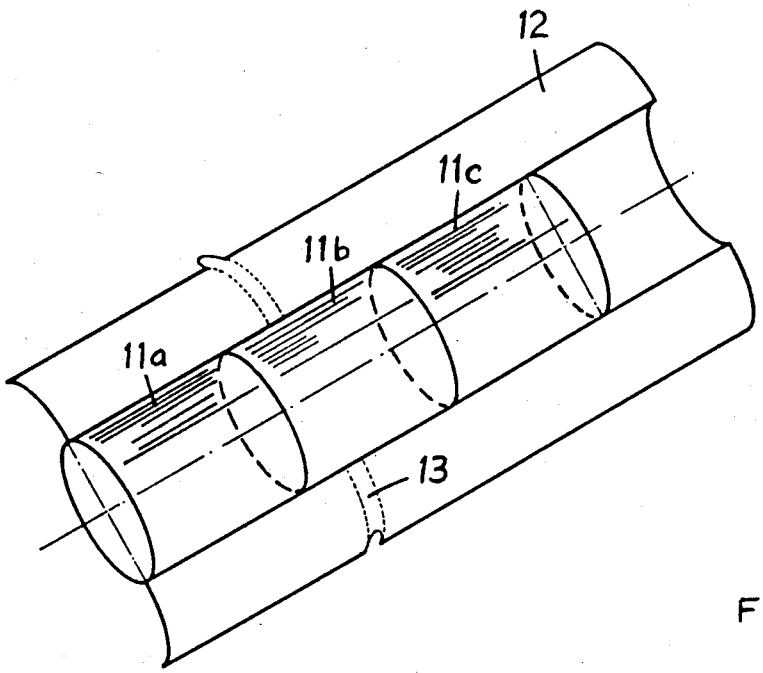
FIG. 5 is a view similar to that of FIG. 4, showing a filter composed of abutting filter elements.

Whereas in FIGS. 1 to 4 the filter 11 is a simple unitary rod of filter material, the filter in the cigarette shown in FIG. 5 is composed of three aligned and abutting elements 11*a*, 11*b* and 11*c*. Each of these may be of any desired material, for example compressed fiber tow, but the center portion 11*b* may be constituted by a powdered or granular filter material held between more coherent outer elements 11*a* and 11*c*.

The arrangement of filter elements, wrapper and removable strip must be such that the integrity of the filter is maintained when the strip is removed. Where the wrapper 12 is a tipping sheet, the three filter elements will commonly be enclosed in their own filter wrapper, which for the purposes of the present invention should be air-permeable. In this case the position of the strip 13 and of the adhesive employed to secure the tipping to the filter is not critical. On the other hand, if the filter does not have a separate wrapper of its own, and particularly if the central region 11*b* is composed of granular material, then the strip 13 and the adhesive must be positioned so that the tipping 12 serves to hold the filter together even after removal of the strip.

Figure 6:
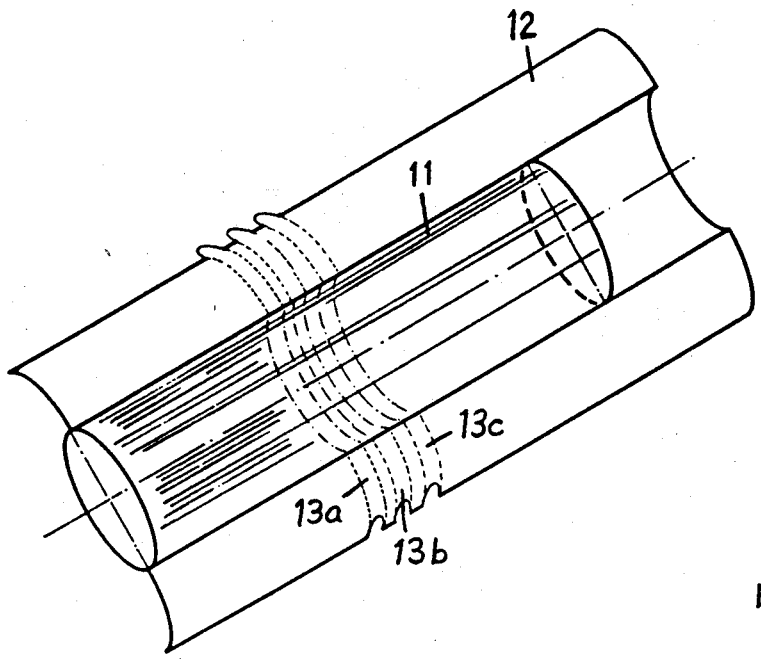
FIG. 6 is a view similar to that of FIG. 4, showing a wrapper provided with several removable annular strips.

In the cigarette shown in FIG. 6, the filter 11 is a unitary rod but three parallel, spaced removable strips 13*a*, 13*b*, 13*c* are provided. One or more of these strips can be removed by the smoker at will, and indicia may be printed on the outside of the strips to assist the smoker in selecting the desired degree of ventilation, or may be printed on the underside of the strips or on an underlying filter wrapper for other purposes.

Figure 7:
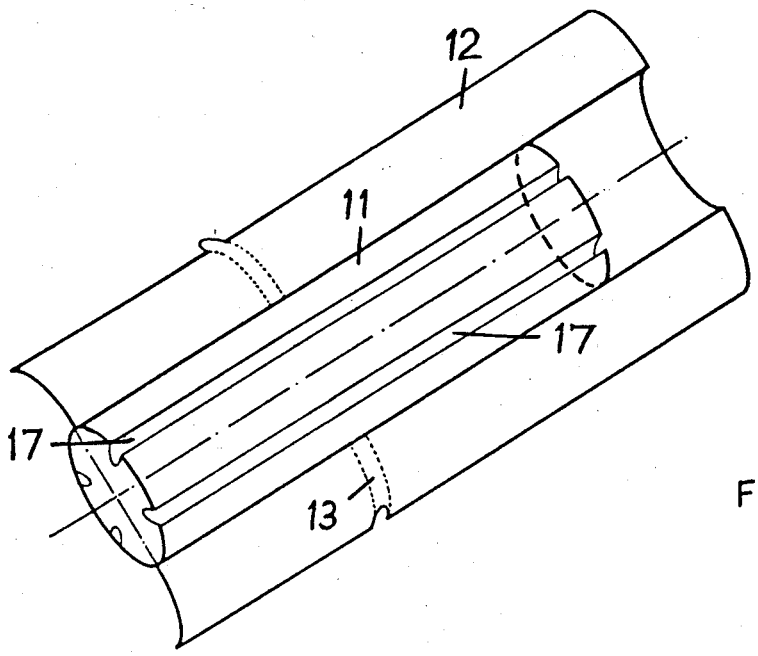
FIG. 7 is a view similar to that of FIG. 4, showing a filter having peripheral grooves extending along it.

In the cigarette shown in FIG. 7, the unitary filter rod 11 is formed with a series of spaced peripheral grooves 17 extending the full length of the filter rod. The peripheral surface of the filter and the walls of the grooves may be made permeable or impermeable to air in a known manner, depending on the function required of the filter.

Figure 8:
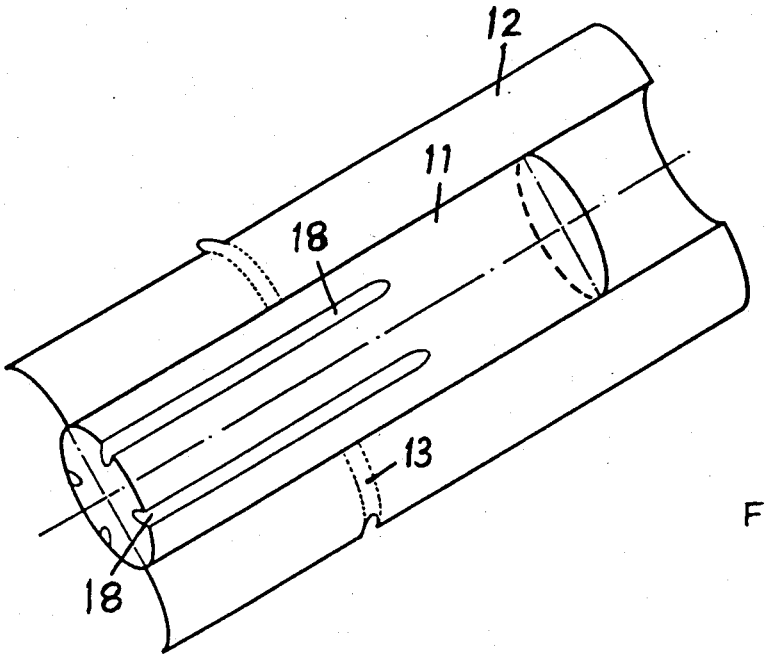
FIG. 8 is a view similar to that of FIG. 4, showing a filter having peripheral grooves extending only partway along the filter.

In the cigarette shown in FIG. 8, peripheral grooves are formed in the filter but extend only part-way along its length. If the removable strip 13 is to cooperate with the grooves to admit ventilating air directly into them, then the strip must be placed around the portion of the filter rod where the grooves extend, as shown in the drawing. Where it is desired that the ventilating air should mix with the smoke principally or solely in the mouth of the smoker and only slightly or not at all within the body of the cigarette, the peripheral surface of the filter rod 11 and the walls of the grooves 18 may be partially or wholly impervious to air.

Annular removable strips in accordance with this invention can also be used to release detachable portions of a filter to reduce the effective length of the filter. For example, if in the embodiment of FIG. 5 the strip at the mouth end portion of the wrapper 12 is not adherent to the filter element 11*b*, complete removal of the strip will cause the element 11*a* to be detached.

In an alternative arrangement, if element 11*b* is not adherent to the inner remainder of the wrapper 12, complete removal of the strip will permit removal of the elements 11*a* and 11*b* and the formation of a recess within the remainder of the wrapper.

What is claimed is:

1. A filter cigarette having a controllable degree of ventilation, comprising:

a rod of filter material, said rod having an air-permeable circumferential surface;

a coaxial and abutting rod of smokable material; and a wrapper surrounding the filter rod and retaining it on the end of the rod of smokable material, and having a controllable degree of ventilation; wherein at least one portion of the wrapper overlying the air-permeable surface of said filter material and comprising an annular strip extending circumferentially completely around the cigarette at a distance from the mouth end thereof is delimited by at least one line of weakness in the wrapper to constitute at least one tear strip, each tear strip being at least partly removable with severance of said line of weakness to expose a portion of the surface of the filter, whereby ventilating air can pass beneath the wrapper to reach the mouth end of the cigarette.

2. A cigarette according to claim 1 wherein the wrapper is adherent to the filter on either side of the circumferential annular strip.

3. A cigarette according to claim 2 wherein the filter comprises at least two aligned or abutting filter elements.

4. A cigarette according to claim 1 wherein said portion comprises at least two annular strips spaced apart along the filter.

5. A cigarette according to claim 4 wherein the wrapper is adherent to the filter on either side of the circumferential annular strips.

6. A cigarette according to claim 5 wherein the filter comprises at least two aligned or abutting filter elements.

7. A cigarette according to claim 1 wherein the removable portion of the wrapper is formed with at least one tab region partly defined by severance of the wrapper, whereby said at least one tab region is easily lifted to remove at least part of said portion.

8. A filter cigarette having a controllable degree of ventilation, comprising:

a rod of filter material, said rod having an air-permeable circumferential surface;

a coaxial and abutting rod of smokable material; and a wrapper surrounding the filter rod and retaining it on the end of the rod of smokable material, and having a controllable degree of ventilation; wherein at least one portion of the wrapper overlying the air-permeable surface of said filter material and extending circumferentially at least partly around the cigarette at a distance from the mouth end thereof is delimited by at least one line of weakness in the wrapper to constitute at least one tear strip, each tear strip being at least partly removable with severance of said line of weakness to expose a portion of the surface of the filter, the surface of the filter being formed with at least one longitudinal groove opening at at least one end of the filter and extending beneath said portion of the wrapper, whereby ventilating air can pass beneath the wrapper to reach the mouth end of the cigarette.

9. A filter cigarette having a controllable degree of ventilation, comprising:

a filter comprising at least two aligned or abutting filter elements, said elements comprising at least one outer filter element adjacent said mouth end of the cigarette and at least one inner filter element aligned therewith and adjacent said rod of smokable material;

a coaxial and abutting rod of smokable material; and a wrapper surrounding the filter and retaining it on the end of the rod of smokable material, and having a controllable degree of ventilation; wherein at least one portion of the wrapper comprising an annular strip overlying the filter and extending circumferentially completely around the cigarette at a distance from the mouth end thereof is delimited by at least one line of weakness in the wrapper and is at least partly removable to expose a portion of the surface of the filter, whereby ventilating air can pass beneath the wrapper to reach the mouth end of the cigarette;

said annular strip overlies one of said outer elements; and the wrapper is adherent to the filter on either side of the circumferential annular strip, the portion of said wrapper on the side of the annular strip adjacent said mouth end being adherent to said outer element and the portion of said wrapper on the said of the annular strip remote from said mouth end being adherent to said inner element and nonadherent to said outer element.

10. A filter cigarette having a controllable degree of ventilation, comprising:

a filter comprising at least two aligned or abutting filter elements, said elements comprising at least one outer filter element adjacent said mouth end of the cigarette and at least one inner filter element aligned therewith and adjacent said rod of smokable material;

a coaxial and abutting rod of smokable material; and a wrapper surrounding the filter and retaining it on the end of the rod of smokable material, and having a controllable degree of ventilation; wherein at least one portion of the wrapper comprising an annular strip overlying the filter and extending circumferentially completely around the cigarette at a distance from the mouth end thereof is delimited by at least one line of weakness in the wrapper and is at least partly removable to expose a portion of the surface of the filter, whereby ventilating air can pass beneath the wrapper to reach the mouth end of the cigarette;

said annular strip overlies one of said inner elements; and the wrapper is adherent to the filter on either side of the circumferential annular strip, the portion of said wrapper on the side of the annular strip adjacent said mouth end being adhereent to said outer element and nonadherent to said inner element, and the portion of said wrapper on the side of the annular strip remote from said mouth end being adherent to said inner element.

* * * * *